US006326941B1

(12) United States Patent
Yamazaki et al.

(10) Patent No.: US 6,326,941 B1
(45) **Date of Patent: *Dec. 4, 2001**

(54) ELECTRO-OPTICAL DEVICE AND METHOD OF DRIVING THE SAME

(75) Inventors: Shunpei Yamazaki, Tokyo; Masaaki Hiroki; Yasuhiko Takemura, both of Kanagawa, all of (JP)

(73) Assignee: Semiconductor Energy Laboratory Co., Ltd., Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 07/957,106

(22) Filed: Oct. 7, 1992

(30) Foreign Application Priority Data

Oct. 8, 1991 (JP) ..... 3-290721

(51) Int. Cl.[7] ..... G09G 3/36
(52) U.S. Cl. ..... 345/95; 345/89
(58) Field of Search ..... 340/784, 805, 340/793; 345/94, 95, 208, 209, 210, 89, 87, 77, 63

(56) References Cited

U.S. PATENT DOCUMENTS

| | | | | |
|---|---|---|---|---|
| 4,130,777 | | 12/1978 | DeJule . | |
| 4,427,978 | * | 1/1984 | Williams | 340/793 |
| 4,427,979 | * | 1/1984 | Clerc et al. | 340/784 |
| 4,743,096 | * | 5/1988 | Wakai et al. | 340/784 |
| 4,775,891 | * | 10/1988 | Aoki et al. | 340/784 |
| 5,010,327 | * | 4/1991 | Wakita et al. | 340/784 |
| 5,010,328 | * | 4/1991 | Morris et al. | 345/208 |
| 5,136,618 | * | 8/1992 | Wright, Jr. | 358/426 |
| 5,488,387 | | 1/1996 | Meada et al. . | |

FOREIGN PATENT DOCUMENTS

| | | |
|---|---|---|
| 50-051693 | 5/1975 | (JP) . |
| 61-103199 | 5/1986 | (JP) . |
| 62-262030 | 11/1987 | (JP) . |
| 63-182695 | 7/1988 | (JP) . |
| 03-020780 | 1/1991 | (JP) . |

* cited by examiner

*Primary Examiner*—Chanh Nguyen
(74) *Attorney, Agent, or Firm*—Eric J. Robinson; Nixon Peabody LLP

(57) ABSTRACT

For a gradation displaying operation of an electro-optical device, a gradation display method and an electro-optical device therefor which can be controlled with a digital signal, and which is hard to be affected by variation in characteristics between elements and can achieve high gradation display are provided. In the active matrix type of electro-optical device and method, the input analog signal is converted to a numerical value of N-radix notation, and pulses whose pulse height and width correspond to the numerical value. By applying these plural pulses to each picture element electrode, an average voltage of one frame of an image can be made an arbitrary value to finally display an intermediate color tone or gradation. The display device comprises a device for converting an input analog signal to a digital signal, a device for converting the digital signal to a numerical value of N-radix notation or a digital signal corresponding thereto (including digital signal), and a device for inputting this signal to an active matrix type device.

17 Claims, 6 Drawing Sheets

ELECTRO-OPTICAL DEVICE AND METHOD OF DRIVING THE SAME

BACKGROUND OF THE INVENTION

1. Field of the Invention

This invention relates to an electro-optical display device constructed by plural picture elements which are arranged in a matrix form and have driving switch elements, and a display system for implementing a high-gradation display for an image displaying operation of a liquid crystal display, a plasma display, a vacuum microelectronics display and the like.

2. Description of Related Art

The recent miniaturization of various office automation equipments has caused a conventional cathode ray tube (CRT) to be replaced by a thin-type display (flat panel display) such as a plasma display, a liquid crystal display and the like. In addition, there has been also researched a vacuum microelectronics display in which micro vacuum tubes each comprising a field emission cathode and a grid are arranged in a matrix array and an image is displayed by irradiating an electron beam emitted from the matrix array onto fluorescent material. In all the display devices as described above, an image display operation is performed by controlling a voltage to be applied to intersections of the matrix array.

That is, a transmitted-light amount or a scattered-light amount is varied by an electric field in a display of liquid crystal material, an electric discharge is induced between electrodes by an electric field in a plasma display, and electrons are emitted from a cathode by field emission effect in a vacuum microelectronics display.

The simplest one of these matrix types is a display including a pair of substrates which are confronted to each other, and striped wirings which are arranged longitudinally and laterally on the respective substrates, a voltage being generated in a gap between any intersected longitudinal and lateral wirings by applying a voltage therebetween. This type is called as a simple matrix-structure. This type of display can be produced easily and at low cost because of its simple structure. However, in this type of display, there has been frequently occurs a phenomena called as crosstalk in which an image is blurred due to unintentional signal flow into undesired parts in a driving operation of the display. In order to avoid the crosstalk, material whose optical characteristic varies sharply with a voltage above a predetermined threshold voltage is required. For example, a plasma electric discharge display is a favorable display for such a simple-matrix system because it has a distinct threshold value as described above.

When such an optical material as described above is used, however, the display must be driven such that a voltage for each picture element (that is, a crossing between matrix wirings) is extremely near to the threshold voltage. Therefore, when the simple matrix system is adopted, an optical ON/OFF-switching operation can be carried out, but it is difficult to obtain an intermediate brightness or color tone because material which can vary its brightness in an intermediate variable range in accordance with an applied voltage can not be used as an optical material for the display.

This problem is caused by placing the switching function on an optical material (liquid crystal or electric discharge gas). Therefore, an attempt of installing a switching element to the matrix independently of the optical material was tried. This type of device is called as an active matrix display and has one or more switching elements at each picture element. A PIN diode, an MIM diode or a thin film transistor or the like is used as a switching element.

However, even though an active matrix system is adopted, it is difficult to achieve a display operation with high gradation as realized in CRT.

FIG. 1(A) shows a conventional gradation display system. In FIG. 1(A), the ordinate represents the amplitude of a voltage applied to a specified picture element and the abscissa represents a time, and this figure represents the variation of the voltage applied to a picture element of a liquid crystal display. The voltage is applied in the form of an alternative current pulse of $2\tau$ period because the liquid crystal would be deteriorated due to its electrolysis if it is applied with a direct current for a long time.

In this figure, the voltage is applied so as to display brightness of "8" in first two periods, "4" in next one period and "6" in last one period. Actually, the liquid crystal material varies in its optical characteristic sharply at a particular threshold value, but it is assumed here that the optical characteristic varies linearly in accordance with the applied voltage. This approximation is a very close approximation for the liquid crystal material such as dispersion type liquid crystal material for example. Thus, in order to achieve the display operation with 16-step gradation for example, it is required to control a voltage at 16 steps and then apply it to a picture element.

In a usual liquid crystal material, its optical characteristic is saturated when applied with a voltage over 5 volts, and hardly varies even if a voltage above 5 volts is applied. In order to implement 16-step gradation displaying operation for example, a voltage must be applied with precision of 300 mV which is obtained by dividing 5 volts by 16. It is reasonable that the implementation of a higher-gradation display operation requires a more minute voltage to be applied to the picture element. However, it is not easy to generate a voltage with a resolution of 300 mV or less, and such a minute voltage is attenuated by various factors until it reaches the picture element. These factors contain resistance of wirings, resistance of thin film transistors, reduction of potential of a picture element due to a parasitic capacitance of the thin film transistors and the like. Since these parameters causing the voltage variation or fluctuation are different in accordance with an active element of each picture element, the fluctuation of the voltage of the picture element can be actually suppressed in a range of plus and minus 0.2 V at maximum over the whole panel.

On the other hand, there is another method of implementing a gradation displaying operation by controlling a time length (retention time) of a voltage pulse to be applied to each picture element. For example, display methods as disclosed in Japanese patent application Nos. 3-169305, 3-169306,3-169307, 3-169307, 3-209869, etc. which have been invented by the same inventors as this application are cited as examples of the above method. FIG. 1(B) shows this example. First two periods are used for brightness of "8", next one period is used for brightness of "4" and last one period is used for brightness of "6", as well as the method of FIG. 1(A).

It is known that the liquid crystal material visually functions to display color tone and brightness in accordance with, not an instantaneous voltage, but an average effective voltage. Namely, assuming an effective voltage of first two periods as 1, the next one period is considered as 0.5 though it has the same peak voltage as that of the first two periods, and the last period is considered as 0.75.

Further, a response speed of the plasma electric discharge is a high speed of 1 micro second, but a human naked eye cannot follow such a high speed, and can sense only an average brightness, so that a visual brightness is finally determined by an average effective voltage.

That is, the gradation displaying system as described above requires the switching speed to be remarkably increased particularly in order to implement a high-gradation displaying operation .

FIG. 2 shows a special case of FIG. 1(B), and an example of FIG. 2 can achieve 64-step (64-level) gradation displaying operation. Numbers at the left side represent degree of brightness of picture elements. In this example, the optical characteristic varies from "1" to "54" in this order. In FIG. 2, (A) and (B) are not different essentially, and only the order of plural pulses is altered therebetween. The details of this example are described in Japanese patent application No. 3-209869 which has been invented by the same inventors as this application and thus the description thereof is eliminated.

For example, in a part marked as "17", a pulse whose length is 1 and a pulse whose length is 16 appear once in a period of τ respectively, and it represents an average brightness of "17". Further, in a part marked "37", a pulse whose length is 1, a pulse whose length is 4 and a pulse whose length is 32 appear once in a period of τ, and it represents an average brightness of "37". By this way, 64-step gradation display from "0" to "64" can be achieved.

It is apparent from FIG. 2 that the minimum pulse length is required to be one 64th of a voltage repetitive period of τ. In a case where a switching operation is actually carried out using a thin film transistor or the like, a pulse whose width is shortened in accordance with the number of lines of matrix is applied to the thin film transistor. For example, when the matrix has 480 lines, a pulse whose width is one 480th of the minimum pulse length is applied to the thin film transistor. Since s is usually 30 msec, the minimum pulse width becomes 500 micro sec. Thus, 1 micro sec is required for a driving signal for the thin film transistor or the like. This value may be considered as a large value, but it is very rapid signal for the thin film transistor. Therefore, in order to achieve higher gradation displaying operation, more rapid pulses must be applied, and by this, electromagnetic wave is radiated from the display.

SUMMARY OF THE PRESENT INVENTION

This invention has been implemented to solve the problems described above in a conventional gradation displaying system, and is a new type of gradation displaying system which adopts advantages of both of a gradation displaying system which is completely dependent on a voltage as shown in FIG. 1(A) and a gradation displaying system which is completely dependent on a pulse width as shown in FIG. 1(B). In addition, in this system, both of the remarkably minute voltage control and the remarkably short-speed pulse as pointed out above are not required.

In order to distinguish this invention from the conventional system clearly, an embodiment of this invention is shown in FIG. 1(C). First two periods are used for brightness of "8", next one period is used for brightness of "4" and last one period is used for brightness of "6", like the systems as shown in FIG. 1(A) and FIG. 1(B).

In this invention, the gradation displaying operation is also achieved by utilizing an average effective voltage as well as the system as shown in FIG. 2, however, in this invention, a degree of freedom is increased by varying not only a pulse width, but also a pulse height to solve the above problems. In this invention, an input analog signal is converted, directly or after conversion into a digital signal, into a numerical value of N-radix notation or a digital signal corresponding thereto. For example, in FIG. 1(C), an image is converted to two digits of 4-radix notation. Table 1 shows numbers of 0 to 15 of decimal notation (10-radix notation) which are represented by 4-radix notation.

TABLE 1

| 10-radix notation | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 4-radix notation | 0 | 1 | 2 | 3 | 10 | 11 | 12 | 13 | 20 | 21 | 22 | 23 | 30 | 31 | 32 | 33 |

In an example of FIG. 1(C), "8" is represented with 12 of decimal number, "4" is represented with 6 of decimal number and "6" is represented with 9 of decimal number. According to Table 1, 12, 6 and 9 of decimal number correspond to 30, 12 and 21 of 4-radix notation, respectively. A value which is not a binary number can be represented by varying a pulse width corresponding to each digit. Namely, in the 4-radix notation, a pulse width is increased by four times as the figure raises up. For example, assuming the pulse width of a first digit as 1 (unit period), the pulse width of the second digit is set to 4 (four times as long as the unit period) and the pulse width of the third digit is set to 16 (sixteen times as long as the unit period). This corresponds to the conventional example where the pulse width is increased twice by twice as shown in FIG. 2 (in a digital notation, namely, in a binary notation).

In an example of FIG. 1(C), a pulse whose width is 1 and a pulse whose width is 4 are used because of two-figure notation of 4-radix. For first two periods, only a pulse whose width is 4 and whose height is 3 is applied. For next one period, a pulse whose width is 4 and whose height is 1 and a pulse whose width is 1 and whose height is 2 are applied. For last one period, a pulse whose height is 2 and a pulse whose width is 1 and whose height is 1 are applied. Consequently, assuming the effective value of the pulse voltage to be applied for the first two periods as 1, although the pulse is complicated afterwards, an average effective voltage of the third period is 0.5 and an average effective voltage of the last one period is 0.75. As described above, by changing not only the pulse width, but also pulse height, a load imposed on the pulse width (that is, high-speed pulsation) can be mitigated by the pulse height. This invention is characterized particularly by adopting 4-radix notation or another numeric expression when the pulse height is changed.

N-stage voltages (a plurality of voltage pulses having pulse heights and pulse widths based on the numerical value of N-radix notation, e.g. 4-radix notation) or the digital signal corresponding thereto) are applied to a pixel of the electro-optical device of an active matrix structure.

In FIG. 2, the 64-step (64-level) gradation displaying operation is achieved by combination of total 6 pulses whose width is 1, 2, 4, 8, 16 and 32. On the other hand, in this invention, the pulse height is sectioned into four steps (levels) of 0, 1, 2 and 3, and only three pulses having pulse width of 1, 4 and 16 are used to implement the 64-step gradation displaying operation through calculation of 3 digits of 4-radix notation. Of course, a small number of kinds of pulses means that the minimum pulse width is large.

FIG. 3 shows an example. FIGS. 3(A) and (B) are essentially identical to each other except that the pulse order is altered. In the example of FIG. 3, "1" can be represented by a pulse whose height is 1 and whose width is 1 (minimum pulse). "4" can be represented by a pulse whose height is 1 and whose width is 4. "16" can be represented by a pulse whose height is 1 and whose width is 16. "32" can be represented by a pulse whose height is 2 and whose width is 16. As shown in the FIG. 3, all numbers from "0", "1" to "60" can be represented by a combination of these pulses. It is apparent from this figure that the minimum pulse becomes longer than that of the conventional system. For example, the minimum pulse width of FIG. 2 is $$\tau/(1+2+3+4+8+16+32)=s/63,$$

while that of the example of FIG. 3 is $$\tau/(1+4+16)=s/21,$$

so that the width of the minimum pulse is three times of that of FIG. 2. Thus, increase of electric consumption or load imposed on the device due to the high-speed operation can be reduced remarkably.

In this invention, in place of the 4-radix notation, other radix notations whose radix is 3 (ternary notation) 5 (quinary notation) or higher number can be adopted. FIGS. 4(A) and (B) show gradation displaying operation with 4-digit and 3-radix notation and 3-digit and 5-radix notation, respectively. In the 4-digit and 3-radix notation, $3^4=81$ gradations can be displayed and in the 3-digit and 5-radix notation, $5^3=125$ gradations can be displayed, and the minimum pulse width of the respective cases are s/40 and s/31 respectively.

In FIG. 4(A), a pulse whose width is 1 (unit period) corresponds to a first digit of the 3-radix notation and a pulse whose width is 3 (three times as long as the unit period) corresponds to the second digit of the 3-radix notation. In FIG. 4(B), a pulse whose width is 1 (unit period) corresponds to the first digit of the 5-radix notation and a pulse whose width is 25 (twenty-five times as long as the unit period) corresponds to the second digit of 5-radix notation.

Generally, in a radix notation whose radix is small, the number of the gradation steps is small even though the displaying operation is carried out by same number of digits (using same number of pulses). On the other hand, in a radix notation whose radix is large, high gradation displaying operation can be carried out by a small number of digits (number of pulse). However, when a radix notation whose radix is large is adopted, a setting of a pulse voltage level becomes fine, and thus it is impossible to limitlessly adopt the radix notation whose radix is large due to restriction by an electric circuit. The 3- to 5-radix notation is more suitable. Further, when a radix notation whose radix is large is adopted, the minimum pulse width becomes long even when the same gradation displaying operation is implemented.

As described above, a multi-step gradation displaying operation can be achieved by representing an analog signal, which is generally difficult to be represented, with an N-radix notation and by forming pulses whose width and height are different from one another on the basis of the N-radix notation combining these pulses. In this invention, if a display system with 4-digit and 4-radix notation is adopted, values of 4 levels (steps) are required to be set for a pulse voltage. However, assuming that a threshold voltage of liquid crystal is 5V, these levels are merely set to 0V, 1.67V, 3.33V and 5V to implement a gradation displaying operation with 256 gradations. On the other hand, in the conventional displaying system in which a voltage must be divided (sectioned) into fine values as shown in FIG. 1(A), in order to implement the 256-step gradation displaying operation, an input voltage must be divided into fine voltage levels which is stepwisely increased by 20 mV and this is impossible to be implemented. The foregoing is an essential part of this invention, and a signal input to each display device is more complex in practice. The details of this invention will be described hereunder with reference to embodiments.

DETAILED DESCRIPTION OF THE PREFERRED EMBODIMENT

Figure 1A:
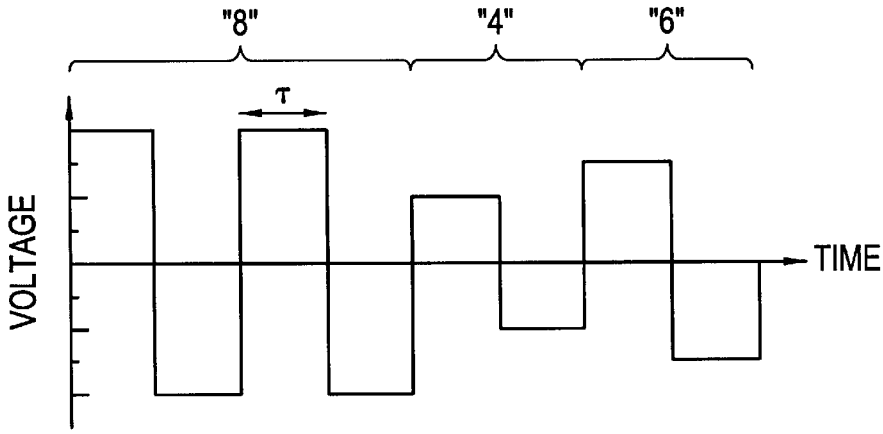
FIG. 1A PRIOR ART
FIG. 1(*a–c*) shows gradation displaying system of this invention and a prior art.

FIG. 5 is a schematic diagram of a display device for implementing this invention. In the device as shown in FIG. 5, only indispensable parts for explaining this invention are described, and other various equipments may be required in practice. This device is assumed to carry out a 256-step gradation displaying operation.

First of all, a video signal is input from an input terminal of this device. Here, the input video signal is assumed to be a signal for a picture element on an n-th column and an m-th row of an image, whose brightness is represented with "212" when the maximum value of brightness is assumed as 256. Of course, other signals are input into this device continually.

After input into the device, this signal is converted to a binary digital signal by an A/D converter. The output digital signal is not indispensable because it will be converted to a numerically-expressed signal using a 4-radix notation later, however, it is required later to temporarily memorize the video signal to perform a signal processing. For example, a signal of each picture element is input one after another, but in the signal processing as adopted in this invention, the signal is not outputted one after another and it is required to store signals of one frame and output them at one time, so that the video signal must be memorized temporally. In this case, if the signal is a digital signal, it can be easily memorized. It is impossible to memorize an analog signal. "212" corresponds to "11010100" in binary expression. In this invention, however, only this digital signal cannot be used directly. Accordingly, this digital signal is converted to a signal which is suitable for this invention by a signal processor at next stage.

In this device, four kinds of pulses whose pulse widths are $T_0$, $4T_0$, $16T_0$, $64T_0$ are used, and the pulse height thereof is set to 4 levels (0, 1, 2, 3).

In this device, a digital signal "11010100" is converted to "3110' in the 4-radix notation. This signal converting operation may be carried out one by one, but output signals which correspond to input signals are preferably memorized beforehand in a memory device inside of a signal processing device and outputted in correspondence to the input signals in consideration of limitation of signal processing speed.

Now, in practice, since this signal processing is carried out in digital circuit, the number "3110" as described above is represented by another expression. Namely, it is represented with a signal into which a numerical value of the 4-radix notation is digitalized (binary). For example, the design of a circuit becomes easier if "311" is represented with "11 01 01 00" like a representation that 3 is represented with 11, 2 with 10, 1 with 01 and 0 with 00. That is, in this signal processing circuit, though a signal is converted to 4-radix notation, but the signal is a digital signal. Both of the former digital signal and the latter digital signal of 4-radix notation numeral value are also available for temporary memorization of data of a picture element. That is, the first digital signal requires memory capacitance of 8 bit for 1 picture element, and this digital signal of 4-radix notation also requires memory capacitance of 8 bit. For example, however, in case of displaying 125 gradations, memory capacitance of 7 bit is required for 3-digit and 5-radix notation because a digitalized signal of video signal is 7 bit (7 digit), while a signal obtained by converting this signal to a numerical value of 5-radix notation requires memory capacitance of 9 bit. This is because the digitalization of each digit of the 5-radix notation requires 3 digits. Thus, in this case, memorization of the first (former) digital signal requires less memory capacitance. Generally, when the number of digits is compared between the first (former) digital signal and the subsequent (latter) digital signal obtained through the sub sequent N-radix notation processing, the number of digits are equal therebetween, or larger in the latter.

Subsequently, signals are output from this signal processing device. The output signals are not output continuously like "3110" (or "11010100" in digital signal expression). Namely, since other picture element data must be outputted simultaneously, this signal is outputted intermittently at an interval between signals of other picture elements like "..3..1..1..0.." (or "..11..01..01.00.." in digital signal expression). A clock pulse is also output simultaneously.

The signals output from the signal processing device in the manner as described above are transmitted to a shift resistor provided on the periphery of a screen. Each signal generates a voltage which is transmitted to a correspond signal line (Y line). In this case, by connecting a voltage generation circuit to the shift resistor or a front stage thereof, the input digital signals may be converted to multistage voltage pulses. The pulses (or electric charges) thus generated are distributed to the respective Y lines by the shift resistor, stored in capacitors connected to the respective Y lines, and kept therein until they are output therefrom. When a driver turns on, the signal voltage is discharged to each Y line.

On the other hand, a clock pulse is transmitted to a shift resistor of a gate line (X line) and the signal is successively transmitted to each gate line.

This device adopts a mechanism in which a voltage value of 3 or 1 is generated by the voltage generation circuit on the basis of the digital signal output from the signal processing device and is held in the capacitor. However, the following mechanism may be adopted. That is, a signal output from the signal processing device is distributed to each Y line, not through the voltage generation circuit, but through the shift resistor, and each Y line is connected to the voltage generation circuit to individually independently supply a voltage corresponding to the signal to the picture element on the basis of the digital signal which reaches each Y line. In a case of using a capacitor, a pulse voltage is not a rectangular wave, but varies greatly with time lapse, and a voltage held in the picture element varies greatly with only a slight shift of a switching timing. The switching timing is dependent on performance of each thin film transistor and it is difficult to produce transistors under precise control of such an analog characteristic of each transistor using the present technology, and thus it is a factor in reducing the yield of the device.

Though this invention requires no fine control of a voltage in comparison with the conventional active matrix system of pure analog drive, 10% fluctuation of the voltage is enough to deteriorate the gradation by one order.

Thus, the analog method using the capacitor as described above is not favorable for this invention. In this point, in a case of using a system in which the voltage pulse is supplied directly from the voltage generation circuit, a pulse to be applied to the Y line has an excellent rectangular wave, and thus a voltage held in any picture element is substantially constant, so that it is favorable for the high-gradation displaying operation (64-step gradation or 256-step gradation, for example) at which this invention aims.

FIG. 6shows a voltage of a picture element $Z_{n,m}$ on the n-th column and the m-th row and a voltage between a gate line $X_n$ and a signal line $Y_m$ (which is also called drain line) which is applied to the picture element. In the figure showing the voltage of the picture element pixel $Z_{n,m}$, a broken line represents an actual signal and a solid line represents an ideal signal. A voltage applied to the picture element does not have an ideal rectangular wave due to various factors. That is, the main factors are a voltage drop due to a so-called diving voltage which is caused by overlap of the gate electrode and the source region, a voltage drop caused by natural discharge from a picture element electrode, and a delay of ON/OFF switching operation of the thin film transistor. Although the analog type voltage supply means is not adopted, the disorder of the signal waveform as described above due to the analog factors in the active matrix is not favorable for this invention as described above. Thus, these factor must be considered fully for a practical circuit design.

Figure 6:
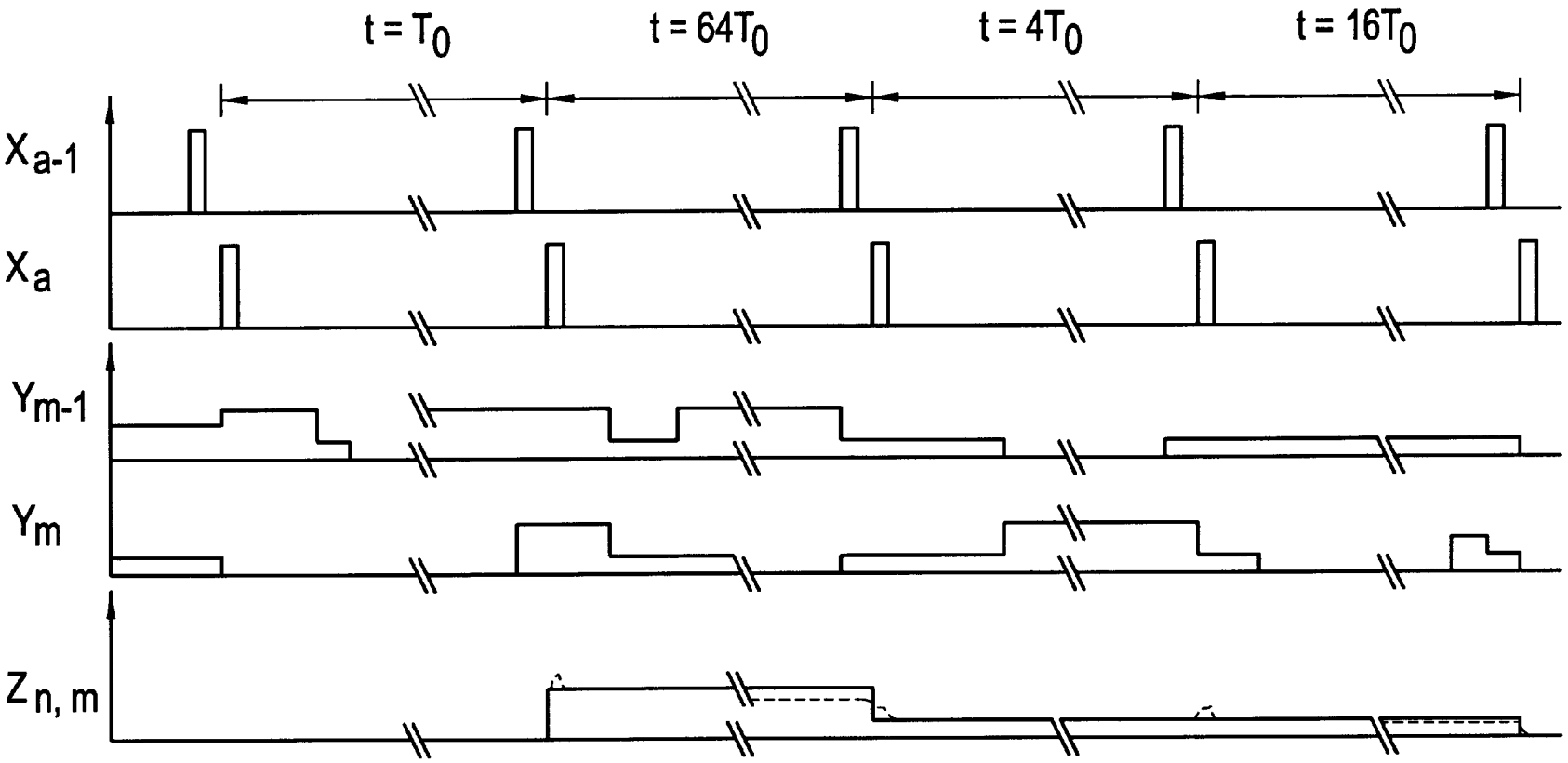
FIG. 6 shows an applied signal and the like in the image display device utilizing this invention.

As shown in FIG. 6, in a picture element, a zero-voltage state first continues for $T_0$, subsequently a highest-voltage state (3-voltage state) continues for $64T_0$, subsequently the voltage is dropped to 1 for a subsequent $4T_0$, and subsequently a 1-voltage state continues for a last $16T_0$. Through this operation, an average voltage of 212/85 per time To can be obtained.

The voltage of the picture element $Z_{n,m}$ at this time is an assembly of rectangular pulses as shown in a lower part of FIG. 5. Assuming a period of 1 frame as 17 msec, $T_0$=200 micro seconds, and the width of pulses applied to a gate electrode is 210 nsec when total number of X lines is 480. The minimum width of the pulse signal applied to the Y line is also 420 nsec. These numbers correspond to several MHz frequency.

On the other hand, in the conventional system (FIG. 2), a gate pulse of 75 nsec which is about one third of the above value is required. This corresponds to 13 MHz frequency, and in order to achieve such a high-speed operation, for example, it has been required to produce an active element in CMOS form. Further, an electromagnetic wave which is radiated from a display due to the high-frequency driving as described above has induced a problem. However, such a problem rarely occurs in this invention of course, the active element produced in the CMOS form can be also available for this invention.

According to this invention, an image having remarkably high gradation can be obtained. This invention is particularly suitable for the liquid crystal display, however, it is applicable to other display systems such as a plasma display, a vacuum microelectro display, etc. Optical material which has not only an ON/OFF switching function, but also an intermediate optical characteristic in accordance with an applied voltage is particularly favorable to this invention. The intermediate brightness can be displayed on the display by a plurality of voltage pulses of the present invention.

Therefore, this invention can be implemented particularly using any material whose optical characteristic varies in accordance with an applied voltage, and which develops the intermediate state with the applied voltage.

What is claimed is:

1. A method of driving an electro-optical device of an active matrix structure comprising the steps of:

converting an input analog signal into a numerical value of N-radix notation where $N \geqq 3$ or a signal corresponding to said numerical value of N-radix notation where $N \geqq 3$; and applying a plurality of voltage pulses having pulse heights and pulse widths based on said numerical value or said signal corresponding to said numerical value of N-Radix notation where $N \geqq 3$ to a pixel of said elect-optical device, wherein an average effective voltage of said voltage pulses is close to an arbitrary voltage; and wherein both the said pulse widths and said pulse heights are varied so that the minimum width of said pulses can be increased.

2. The method of claim 1 wherein said electro-optical device is a display and an intermediate brightness can be displayed on said display by said voltage pulses.

3. The method of claim 1 wherein said pulse heights are four heights.

4. The method of claim 3 wherein said pulse widths are two widths.

5. The method of claim 4 wherein said pulse widths are a width of a unit period and a width four times as long as said unit period.

6. The method of claim 3 wherein said pulse widths are three widths.

7. The method of claim 6 wherein said pulse widths are a width of a unit period and a width four times as long as said unit period and a width sixteen times as long as said unit period.

8. The method of claim 1 wherein said N-radix notation is a ternary notation.

9. The method of claim 1 wherein said N-radix notation is a quinary notation.

10. The method of claim 1 wherein said pulse widths are a width of a unit period and a width three times as long as said unit period.

11. The method of claim 1 wherein said pulse widths are a width of a unit period and a width twenty-five times as long as said unit period.

12. The method of claim 1 wherein said electro-optical device is a liquid crystal display, a plasma display or a vacuum microelectro display.

13. The method of claim 1 wherein said plurality of voltage pulses have "N" levels.

14. The method of claim 1 further comprising the step of converting said analog signal into a binary digital data and converting said binary digital data into said numerical value of N-radix notation.

15. An electro-optical device of an active matrix structure comprising:

a device for converting an input analog signal into a digital signal;

a device for converting said digital signal into a numerical value of N-radix notation where $N \geqq 3$ or a digital signal corresponding to said numerical value of N-radix notation where N24; and a device for generating N-stage voltages having pulse heights and pulse widths on the basis of said digital signal corresponding to said numerical value of N-radix notation where $N \geqq 3$; and wherein both the said pulse widths and said pulse heights are varied so that the minimum width of said pulses can be increased.

16. The device of claim 15 wherein said device for converting an input analog signal into a digital signal is A/D converter.

17. The device of claim 15 wherein said electro-optical device is a liquid crystal display, a plasma display or a vacuum microelectro display.

* * * * *

UNITED STATES PATENT AND TRADEMARK OFFICE

CERTIFICATE OF CORRECTION

PATENT NO. : 6,326,941 B1
DATED : December 4, 2001
INVENTOR(S) : Yamazaki et al.

It is certified that error appears in the above-identified patent and that said Letters Patent is hereby corrected as shown below:

Title page,
In the exemplary drawing, please replace both occurrences of "Shift Resistor" with -- Shift Register --; and replace "CONVERTOR" with -- CONVERTER --.

Drawings,
Sheet 5, Figure, 5A, please replace both occurrences of "Shift Resistor" with -- Shift Register --, and replace "CONVERTOR" with -- CONVERTER --.

Column 3,
Line 44, replace "Since s" with -- Since τ --;

Column 5,
Lines 20 and 24, replace "s" with -- τ --; and
Line 37, replace "s/40" with -- τ/40 -- and "s/31" with -- τ/31 --.

Figure 1B:
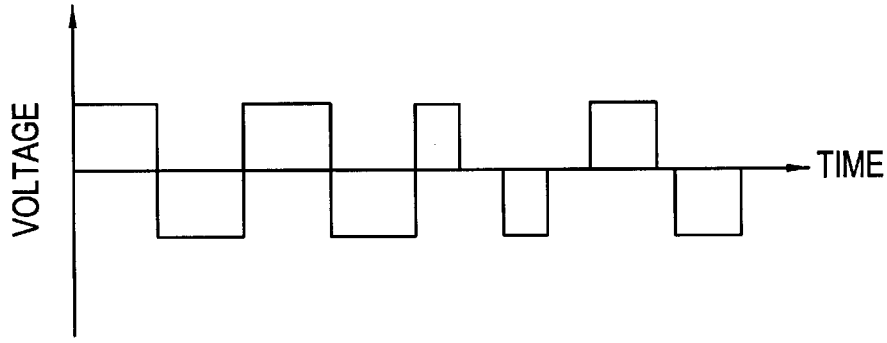
FIG. 1B PRIOR ART
Figure 1C:
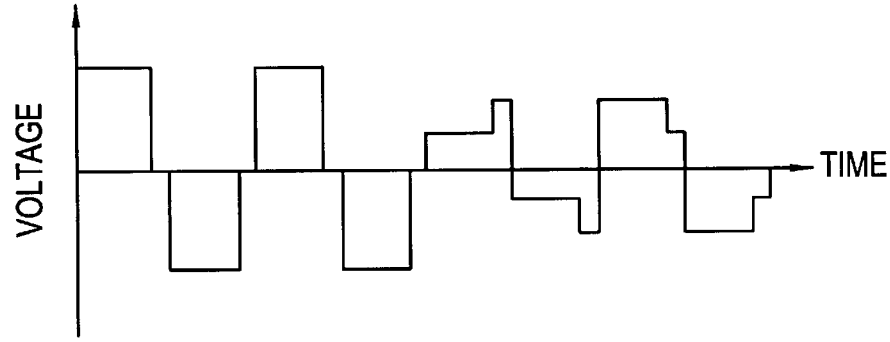
Figure 2A:
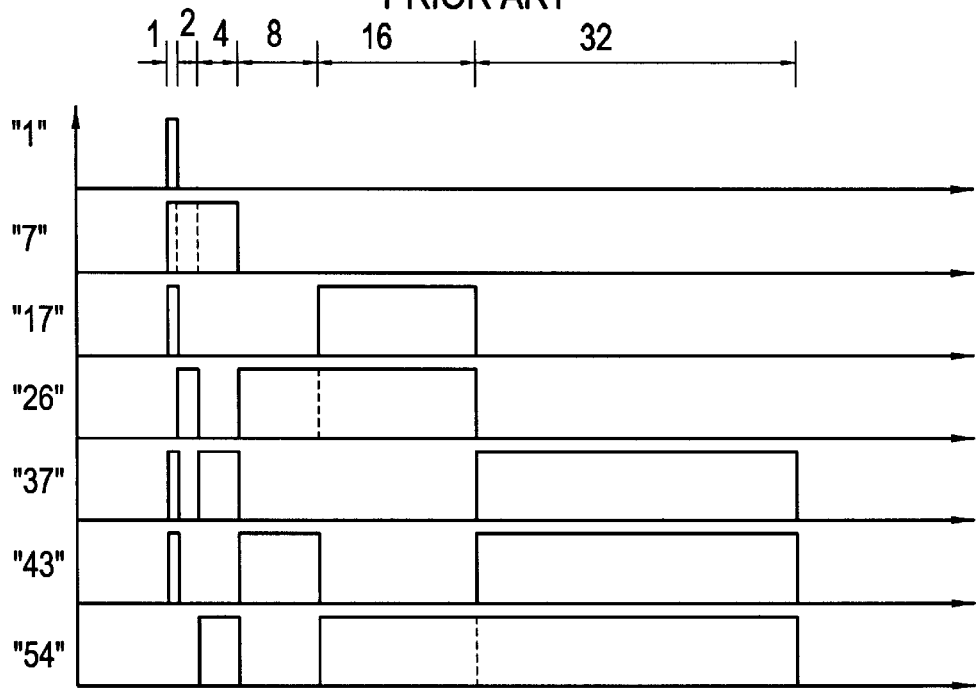
FIG. 2A PRIOR ART
FIG. 2(*a–b*) shows an example of the conventional gradation displaying system.
Figure 2B:
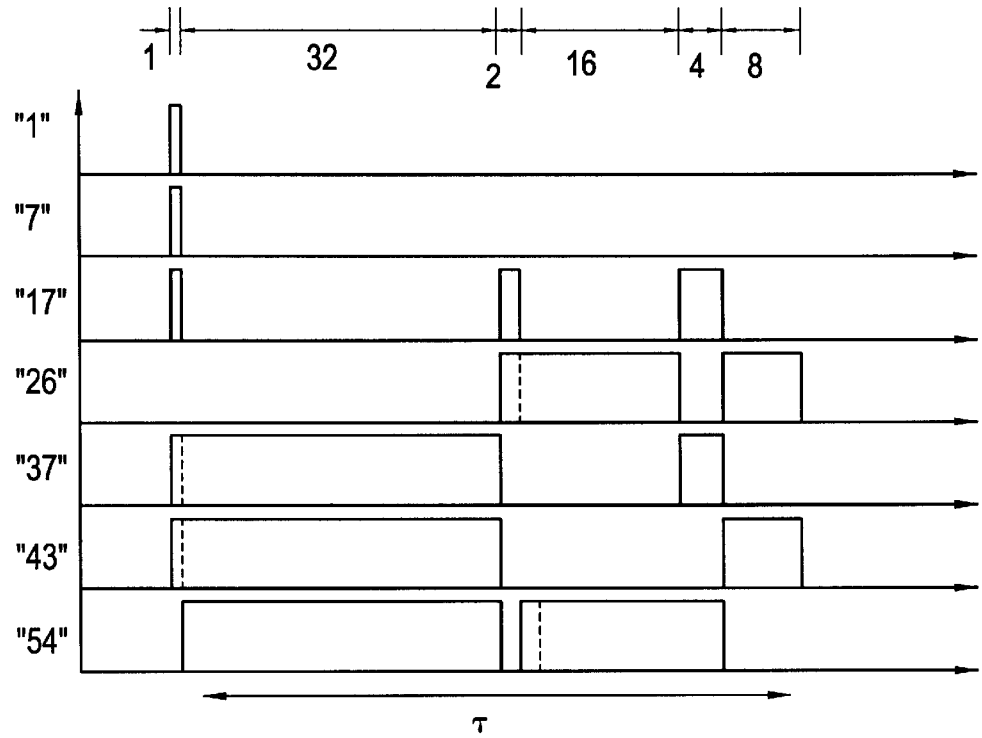
FIG. 2B PRIOR ART
Figure 3A:
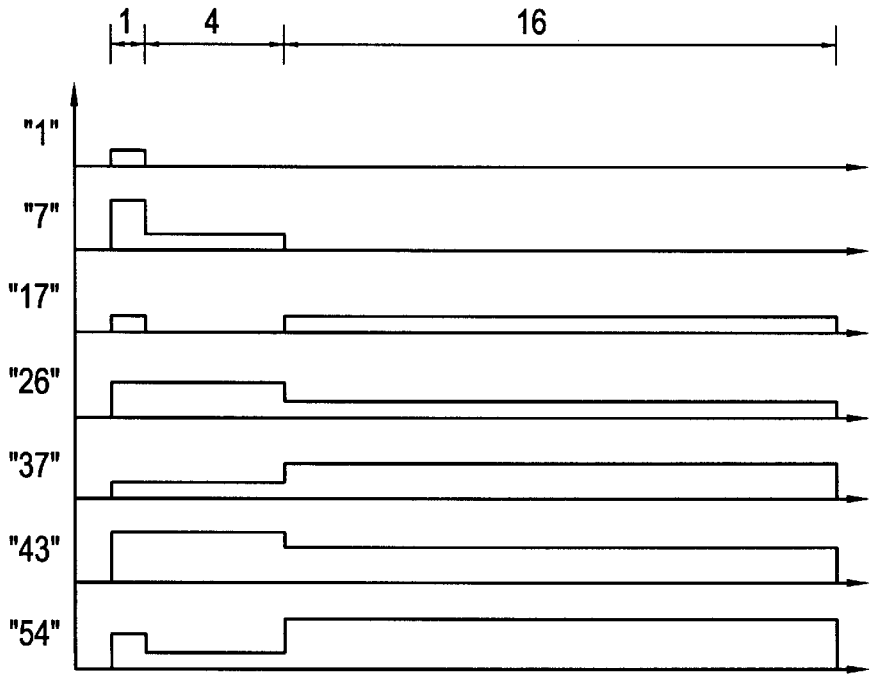
FIG. 3(*a–b*) shows gray level displaying means of this invention.
Figure 3B:
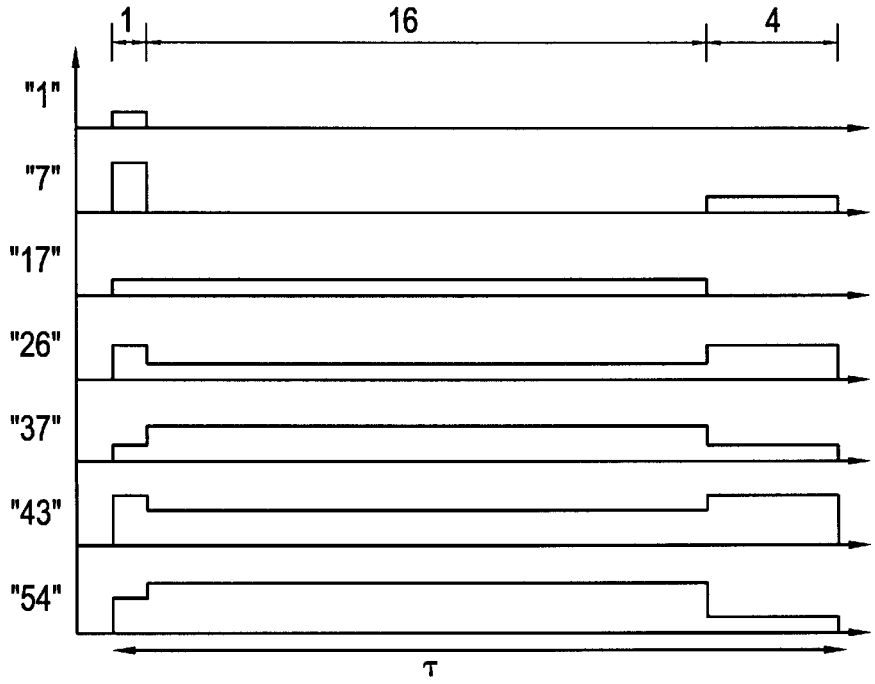
Figure 4A:
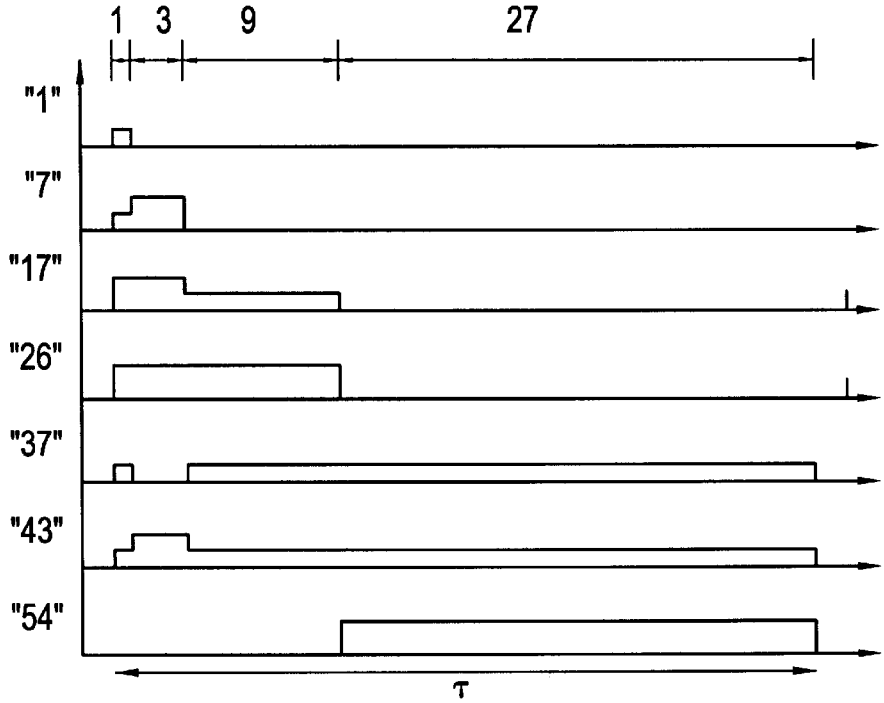
FIG. 4(*a–b*) shows an embodiment of the gradation displaying system of this invention.
Figure 4B:
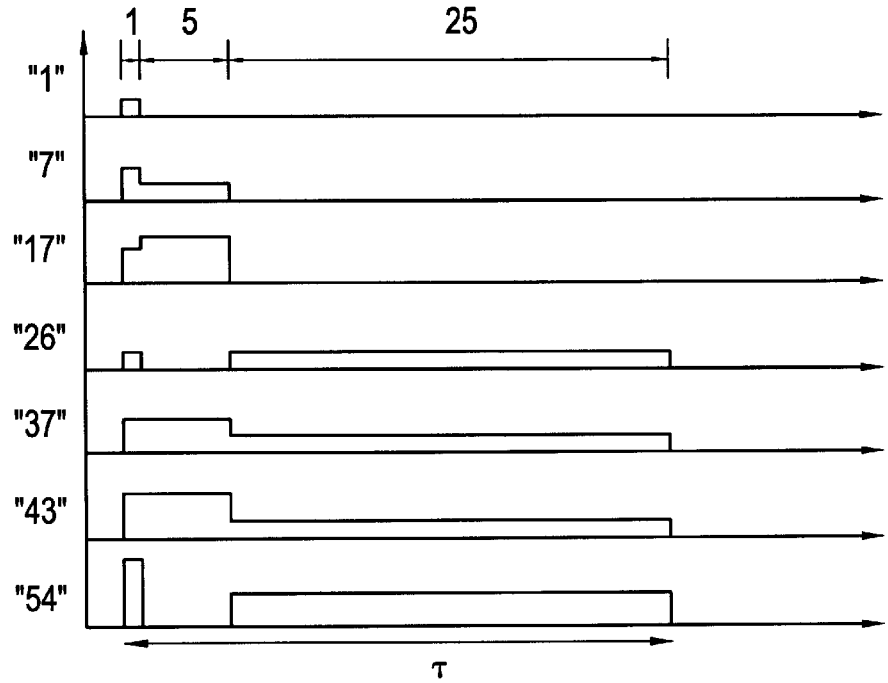
Figure 5A:
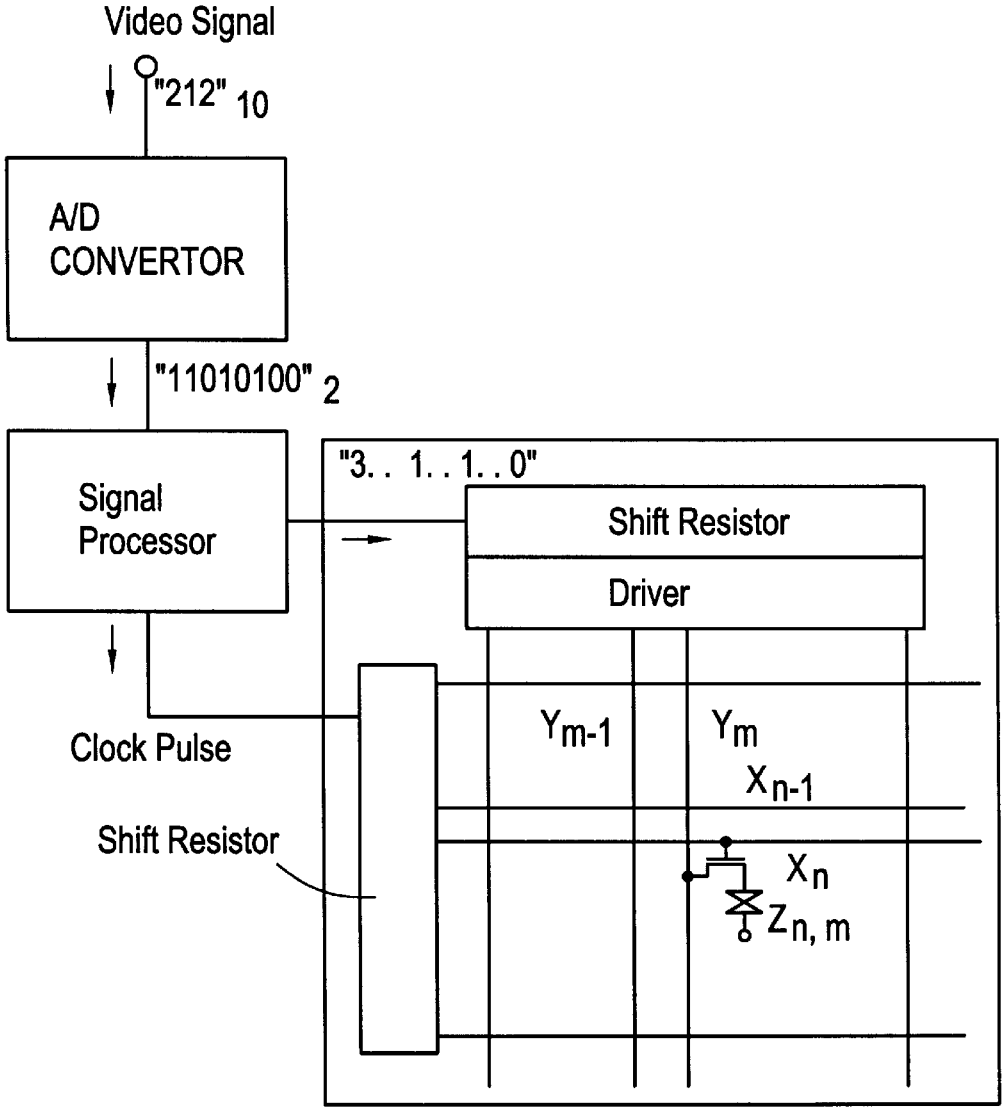
FIG. 5 shows an embodiment of an image display device utilizing this invention.
Figure 5B:
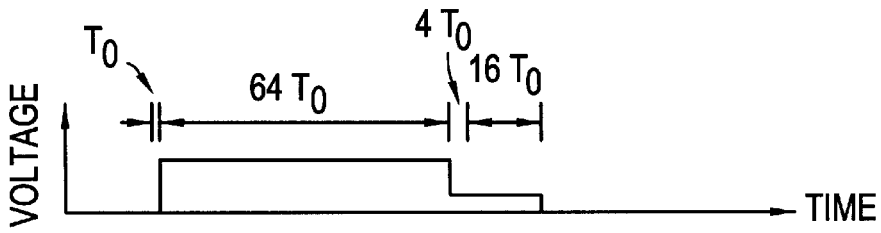

Column 6,
Please replace lines 17-24 with the following:
-- Figs. 1A to 1C show gradation displaying system of this invention and a prior art;
Figs. 2A to 1B show an example of the conventional gradation displaying system;
Figs. 3A to 3B show gray level displaying means of this invention;
Figs. 4A to 4B show an embodiment of the gradation displaying system of this invention;
Figs. 5A to 5B show an embodiment of an image display device utilizing this invention; and --.

Column 7,
Line 34-35, please replace "sub sequent" with -- subsequent --;
Lines 47, 50, 54 and 59, please replace "resistor" with -- register --;
Line 48, please replace "correspond" with -- corresponding --.

Column 8,
Line 2, please replace "resistor" with -- register --.

UNITED STATES PATENT AND TRADEMARK OFFICE

CERTIFICATE OF CORRECTION

PATENT NO. : 6,326,941 B1
DATED : December 4, 2001
INVENTOR(S) : Yamazaki et al.

It is certified that error appears in the above-identified patent and that said Letters Patent is hereby corrected as shown below:

Colunm 10,
Line 33, please replace "N24" with -- N≧3 --.

Signed and Sealed this

Fourteenth Day of December, 2004

JON W. DUDAS
*Director of the United States Patent and Trademark Office*